US008474547B2

(12) United States Patent
Oothoudt et al.

(10) Patent No.: US 8,474,547 B2
(45) Date of Patent: Jul. 2, 2013

(54) ISOLATION SYSTEM FOR DRILLING SYSTEMS

(75) Inventors: Thomas J. Oothoudt, Little Falls, MN (US); Robert Eugene Able, Bozeman, MT (US)

(73) Assignee: Longyear TM, Inc., South Jordan, UT (US)

( * ) Notice: Subject to any disclaimer, the term of this patent is extended or adjusted under 35 U.S.C. 154(b) by 815 days.

(21) Appl. No.: 12/251,120

(22) Filed: Oct. 14, 2008

(65) Prior Publication Data

US 2010/0089653 A1 Apr. 15, 2010

(51) Int. Cl.
*E21B 4/00* (2006.01)

(52) U.S. Cl.
USPC ..... 173/162.1; 173/162.2

(58) Field of Classification Search
USPC ..... 173/162.1, 162.2; 175/55, 56
See application file for complete search history.

(56) References Cited

U.S. PATENT DOCUMENTS

| | | | | |
|---|---|---|---|---|
| 587,388 | A * | 8/1897 | Conrad | 74/551.9 |
| 2,061,806 | A * | 11/1936 | Noble | 173/162.1 |
| 2,970,660 | A * | 2/1961 | Bodine, Jr. | 175/55 |
| 3,124,204 | A * | 3/1964 | Hudnall | 173/145 |
| 3,509,948 | A * | 5/1970 | Besnard | 173/44 |
| 3,684,037 | A * | 8/1972 | Bodine | 175/56 |
| 4,217,677 | A * | 8/1980 | Sumikawa | 16/431 |
| 4,645,017 | A | 2/1987 | Bodine | |
| 5,117,925 | A * | 6/1992 | White | 173/162.1 |
| 5,263,544 | A * | 11/1993 | White | 173/162.1 |
| 5,794,723 | A | 8/1998 | Caneer, Jr. et al. | |
| 6,039,508 | A * | 3/2000 | White | 405/232 |
| 6,186,248 | B1 | 2/2001 | Silay et al. | |
| 6,615,931 | B2 | 9/2003 | Dycus et al. | |
| 7,080,958 | B1 * | 7/2006 | Morris | 405/232 |
| 2004/0113340 | A1 | 6/2004 | Lange et al. | |
| 2005/0155758 | A1 | 7/2005 | Webb et al. | |
| 2006/0185868 | A1 * | 8/2006 | Becht | 173/162.1 |
| 2006/0225922 | A1 * | 10/2006 | Pfahlert | 175/56 |
| 2008/0149392 | A1 | 6/2008 | Saf | |
| 2010/0139912 | A1 | 6/2010 | Pfahlert et al. | |

FOREIGN PATENT DOCUMENTS

| | | |
|---|---|---|
| ES | 2308732 | 12/2008 |
| WO | 2007-037704 A1 | 4/2007 |

OTHER PUBLICATIONS

International Search Report and Written Opinion dated May 28, 2010 as issued in PCT application PCT/US2009/060432 filed Oct. 13, 2009.

Examiner's Report for International Patent Application No. PCT/US2009/060432 (mailed Aug. 8, 2012).

* cited by examiner

*Primary Examiner* — Brian D Nash
(74) *Attorney, Agent, or Firm* — Ballard Spahr LLP

(57) ABSTRACT

An isolation system includes at least one air bladder assembly including at least one air bladder. The isolation system can also include at least one coupling member coupling the air bladder assembly to a drill head. The air bladder is configured to compress and expand to counter oscillating forces generated by the drill head.

25 Claims, 2 Drawing Sheets

ISOLATION SYSTEM FOR DRILLING SYSTEMS

BACKGROUND OF THE INVENTION

1. The Field of the Invention

The present invention relates to drilling systems and to isolation systems for isolating forces generated by a drill head in particular.

2. The Relevant Technology

Core drilling allows samples of subterranean materials from various depths to be obtained for many purposes. For example, drilling a core sample and testing the retrieved core helps determine what materials are present or are likely to be present in a given formation. For instance, a retrieved core sample can indicate the presence of petroleum, precious metals, and other desirable materials. In some cases, core samples can be used to determine the geological timeline of materials and events. Accordingly, core samples can be used to determine the desirability of further exploration in a given area.

Although there are several ways to collect core samples, core barrel systems are often used for core sample retrieval. Core barrel systems include an outer tube with a coring drill bit secured to one end. The opposite end of the outer tube is often attached to a drill string that extends vertically to a drill head that is often located above the surface of the earth. The core barrel systems also often include an inner tube located within the outer tube. As the drill bit cuts formations in the earth, the inner tube can be filled with a core sample. Once a desired amount of a core sample has been cut, the inner tube and core sample can be brought up through the drill string and retrieved at the surface.

Sonic head assemblies are often used to vibrate a drill string and the attached coring barrel and drill bit at high frequency to allow the drill bit and core barrel to slice through the formation as the drill bit rotates. The vibrations transmitted to the drill string can be extremely large, high-frequency forces. While such forces can allow the drill bit to slice through formations, if such forces are transmitted to other parts of the drilling systems, the magnitude and frequency of these forces can result in undesirable shaking and/or damage to the drilling systems.

The subject matter claimed herein is not limited to embodiments that solve any disadvantages or that operate only in environments such as those described above. Rather, this background is only provided to illustrate one exemplary technology area where some embodiments described herein may be practiced

BRIEF SUMMARY OF THE INVENTION

In at least one example, an isolation system includes at least one air bladder assembly including at least one air bladder and at least one coupling member coupling the air bladder to a drill head, wherein the air bladder is configured to compress and expand to counter oscillating forces generated by the drill head.

A drilling system can include a drill head configured to generate oscillating forces; and an isolation system including at least one air bladder assembly having at least one air bladder and at least one coupling member coupling the drill head and the air bladder, the coupling member being configured to couple the oscillating forces to the air bladder such that the air bladder counters the oscillating forces.

A drilling system can include a drill head configured to generate oscillating forces, a mount assembly, and an isolation system having at least one upper air bladder assembly including at least one air bladder, the isolation assembly being configured to allow the drill head to translate relative to the mount assembly and to counter the oscillating forces.

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

Figure 1:
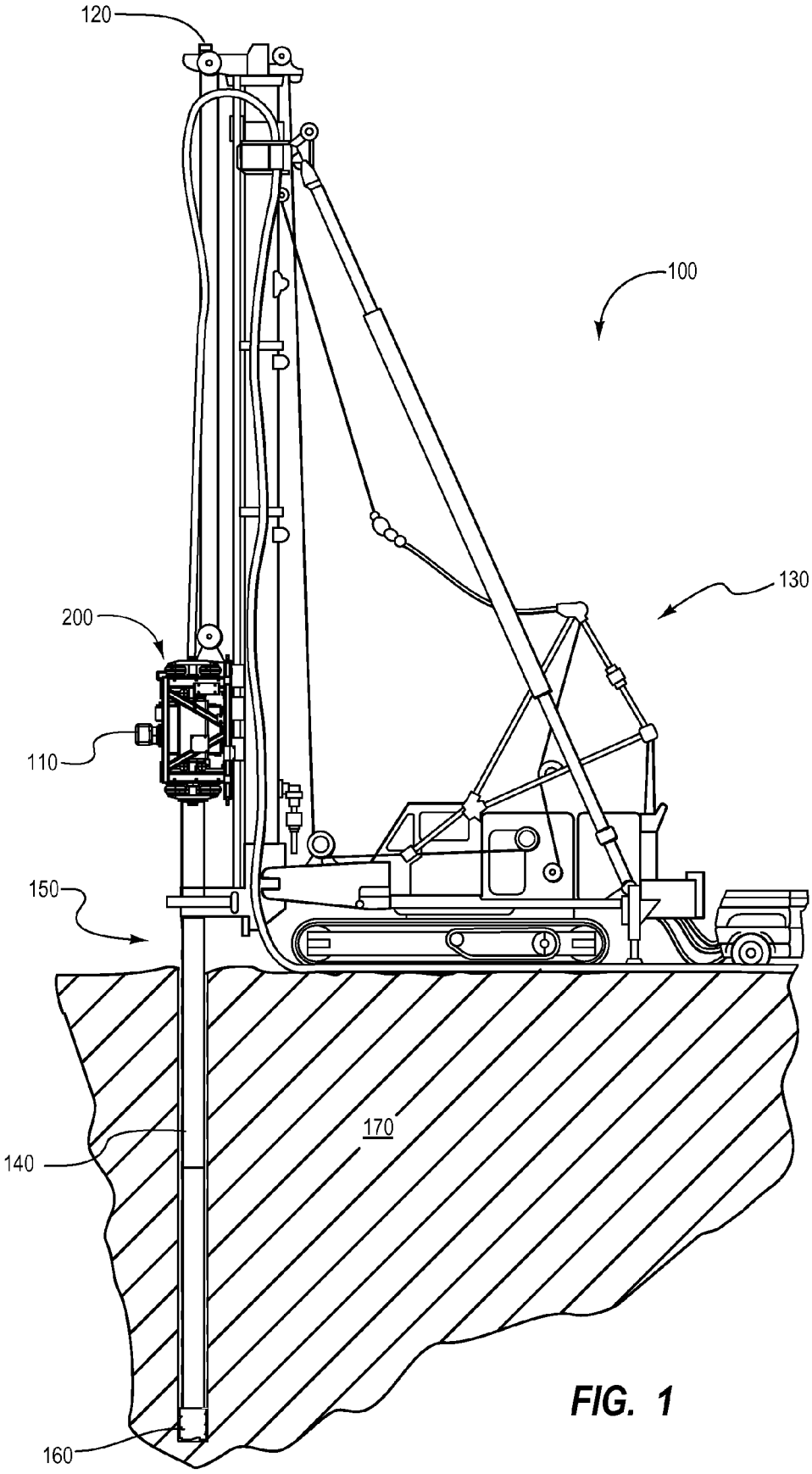
FIG. 1 illustrates a drilling system according to one example.

Together with the following description, the figures demonstrate non-limiting features of exemplary devices and methods. The thickness and configuration of components can be exaggerated in the figures for clarity. The same reference numerals in different drawings represent similar, though not necessarily identical, elements.

DETAILED DESCRIPTION OF THE PREFERRED EMBODIMENTS

Isolation assemblies as well as drill head assemblies and drilling systems including isolation assemblies are provided herein. In at least one example, isolation assemblies isolate the vibratory energy from a vibratory drill head from a drill mast and a drill rig. The vibratory energy instead is transmitted to a drill string where it can be used in sampling operations, to set casings, or in other drilling operations. Isolating a drill mast or rig from vibratory energy can help keep the rig structure from fatigue cracking over time and generally wearing out. In at least one example, isolation assemblies include air bladder assemblies to counter and/or dissipate the vibratory energy.

FIG. 1 illustrates a drilling system 100 having an isolation system 200. The drilling system 100 includes a drill head assembly 110 coupled to a mast 120. The mast 120 is coupled to a drill rig 130. The drill head assembly 110 is configured to have a drill rod 140 coupled thereto. The drill rod 140 can in turn couple with additional drill rods to form a drill string 150. In turn, the drill string 150 can be coupled to a drill bit 160 configured to interface with the material to be drilled, such as a formation 170.

In at least one example, the drill head assembly 110 is configured to rotate the drill string 150. In particular, the rotational rate of the drill string 150 can be varied as desired during the drilling process. Further, the drill head assembly 110 can be configured to translate relative to the mast 120 to apply an axial force to the drill head 110 to urge the drill bit 160 into the formation. The drill head assembly 110 can also apply oscillating vibratory forces to the drill rod 140, which are transmitted from the drill rod 140 through the drill string 150 to the drill bit 160. The isolation system 200 is configured to help isolate the mast 120 from these vibratory forces.

Figure 2:
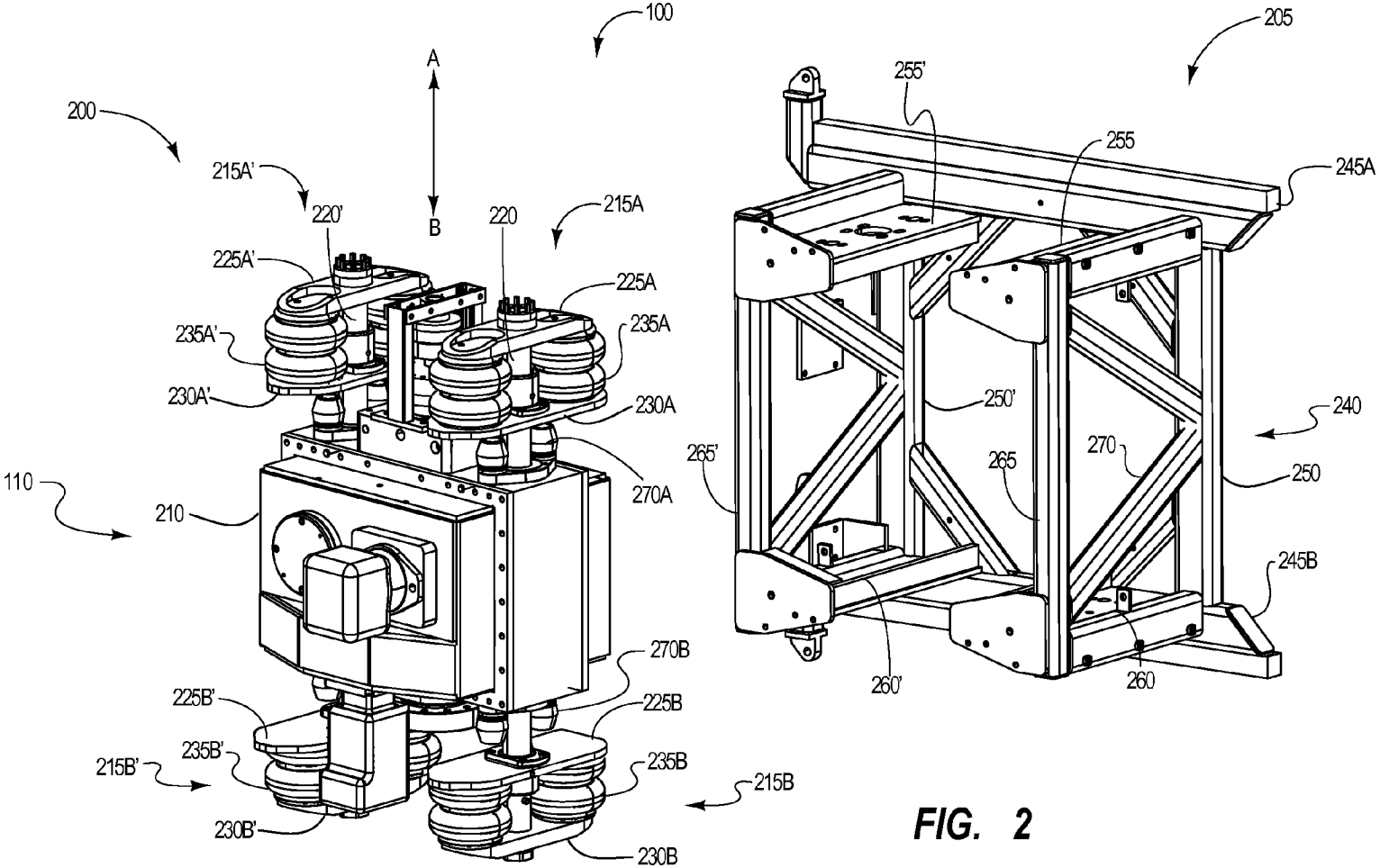
FIG. 2 illustrates a drilling assembly according to one example.

FIG. 2 illustrates a partial view of the drilling system 100 that shows the drill head assembly 110 and the isolation system 200 positioned away from a mount assembly 205. As illustrated in FIG. 2, the drill head assembly 110 generally includes a casing 210. The casing 210 is configured to support and house a vibratory drill head, such as a sonic head assembly, and/or a rotary head assembly.

The rotary head assembly can be configured to rotate a drill rod while the vibratory head can generate cyclically oscillating axial forces. In at least one example, the drill head assembly 110 includes an oscillation assembly having an oscillator housing that supports eccentrically weighted rotors. The eccentrically weighted rotors are configured to rotate within the oscillator housing to generate cyclical, oscillating centrifugal forces. Centrifugal forces due to rotation of the eccentrically weighted rotors can be resolved into first components acting in a drilling direction and second components acting transverse to the drilling direction.

In at least one example, the eccentrically weighted rotors rotate in opposite directions. Further, the eccentrically weighted rotors can be oriented such that as they rotate the centrifugal forces acting transverse to the drilling direction cancel each other out while the first components acting in the drilling direction combine to generate cyclical axial forces. The forces transmitted to a drill rod as well as the forces associated with the movement of the drill head assembly can be referred to generally as oscillating forces. The drill head assembly 110 oscillates parallel to the drilling direction as oscillating forces are transmitted to a drill rod or other component. The isolation system 200 allows the drill head assembly 110 to thus oscillate while reducing the oscillating forces that are transmitted to other components through the mount assembly 205, such as a drill mast 120 (FIG. 1).

As illustrated in FIG. 2, the isolation system 200 includes at least one air bladder assembly. For example, the isolation system 200 can include air bladder assemblies 215A, 215B. The isolation system 200 can further include air bladder assemblies 215A', 215B' associated with an opposing side of the drill head assembly 110. Air bladder assemblies 215A, 215A', 215B, 215B' can include one or more brackets coupled together by a coupling member, such as a guide rail 220. Other coupling members can be used, including any structures that couple the movement of one or more bracket to the drill head assembly 110. In at least one example, coupling members can further couple air bladder assemblies 215A, 215A' to air bladder assemblies 215B, 215B' while in other examples the air bladder assemblies 215A, 215A', 215B, 215B' are independent.

In the illustrated example, the air bladder assemblies 215A, 215A', 215B, 215B' include outer brackets 225A, 225A', 225B, 225B' and inner brackets 230A, 230A', 230B, 230B'. The outer brackets 225A, 225B can be coupled to the guide rail 220 such that movement of the guide rails 220, results in corresponding movement of the outer brackets 225A, 225B. Outer brackets 225A', 225B' can be similarly coupled to guide rail 220'. Accordingly, in at least one example, the guide rail 220 and the outer brackets 225A, 225B translate together while outer brackets 225A', 225B' translate with guide rail 220'.

The inner brackets 230A, 230A', 230B, 230B' are configured to be mounted to a support structure, such as the mount assembly 205. As illustrated in FIG. 2, the mount assembly 205 generally includes a mast mount 240 having an upper support 245A and a lower support 245B joined by one or more struts 250, 250'. Upper support brackets 255, 255' extend away from the upper support 245A while lower support brackets 260, 260' extend away from the lower support 245B. Addition struts 265, 265' can extend between the upper support brackets 255, 255' and the lower support brackets 260, 260'. The mount assembly 205 can further include any number of truss supports 270 extending between various supports and/or brackets to provide additional stability.

In the illustrated example, the guide rails 220, 220' pass at least partially through upper support brackets 255, 255' and lower support brackets 260, 260' to allow the guide rails 220, 220' to translate relative to the mount assembly 205. The guide rails 220, 220' can translate through the upper and lower support brackets 255, 255', 260, 260' parallel to axial directions A and B. Further, as previously introduced, outer brackets 225A, 225B are coupled to the guide rail 220 while outer brackets 225A', 225B' are coupled to the guide rail 220'. Accordingly, the outer brackets 225A, 225A', 225B, 225B' can also translate axially relative to the upper support brackets 255, 255' and the lower support brackets 260, 260'.

Inner brackets 230A, 230A' can be coupled to outer portions of the upper support brackets 255, 255' respectively while inner brackets 230B, 230B' can be coupled to outer portions of the lower support brackets 260, 260'. In at least one example, the upper support brackets 255, 255' provide a relatively stationary base for the inner brackets 230A, 230A' with respect to the outer brackets 225A, 225B. Similarly, the lower support brackets 260, 260' can provide a relatively stationary base for the inner brackets 230B, 230B' with respect to the outer brackets 225B, 225B'. As will be discussed in more detail below, the isolation system 200 is configured to reduce the oscillating forces that are transmitted from the drill head assembly 110 to the mount assembly 205 and consequently to other parts of a drilling system.

In the illustrated example, air bladder assemblies 215A, 215B can be substantially similar to air bladder assembly 215A', 215B'. Accordingly, a discussion of air bladder assemblies 215A, 215B can be applicable to air bladder assemblies 215A', 215B'. It will be appreciated that in other examples air bladder assemblies can be configured differently. As introduced, air bladders 235A can be positioned between outer bracket 225A and inner bracket 230A while air bladders 235B can be positioned between outer bracket 225B and inner bracket 230B. As will be discussed in more detail below, the air bladders 235A, 235B can counter and dissipate oscillating forces, such as those associated with translation of the drill head assembly 110 relative to the base mount 205.

For example, the air bladders 235A can be pressurized to exert opposing forces on the outer bracket 225A and the inner bracket 230A. These forces can generally be referred to as air spring forces. As previously introduced, the outer bracket 225A is coupled to the guide rail 220, which in turn is coupled to the drill head assembly 110. Accordingly, the air spring forces in air bladder 235A can act to oppose gravitational and other forces the drill head assembly 110 exerts on the outer bracket 225A. These forces can include oscillating forces.

As described above, the oscillating forces can cause the drill head assembly 110 to move in axial directions A and B. The directions indicated can be generally parallel to the drilling direction. As the drill head assembly 110 moves in direction B, the guide rail 220 moves the outer bracket 225A also in direction B and toward the inner bracket, which is held relatively stationary with respect to the outer bracket 225A.

Movement of the outer bracket 225A toward the inner bracket 230A compresses the air bladders 235A. As the air bladders 235A compress, the air spring force increases. The increasing air spring force in the air bladders 235 acts on the outer bracket 225A and the inner bracket 230A to thus counter the oscillating force. Countering the oscillating force with the air spring force can act to help isolate a support structure, such as the mount assembly 205, from the oscillating force.

In addition to compressing air bladders 235A between the outer bracket 225A and the inner bracket 230A, movement of the drill head assembly 110 in the direction B can act to expand air bladder 235B located between the outer bracket 225B and inner bracket 230B. In particular, movement of the guide rail 220 in direction B results in corresponding movement of the outer bracket 225B. The air bladders 235B can be coupled to the outer bracket 225B and inner bracket 230B in such a way that movement of the outer bracket 225B away from the inner bracket 230B can expand the air bladders 235B.

In at least one example, the air bladders 235B can be configured to limit or control the amount of air that enters or escapes the air bladders 235B during expansion or compression. Accordingly, a relatively constant amount of air is contained within the air bladders 235B. As a result, as the air bladders 235B expand the air therein expands to fill the increased volume. The expansion of the air into the expanded air bladders 235B can act to damp the oscillating force. Damping the oscillating force can help to isolate the mount assembly 205 from the oscillating forces. Thus, as the oscillating forces drive the drill head assembly 110 in direction B, air bladders 235A compress to counter the oscillating forces while the air bladders 235B expand to damp and thereby dissipate the oscillating forces.

In a similar manner, the air bladder assemblies 215A, 215B can counter and damp the oscillating forces as the oscillating forces move the drill head assembly 110 in direction A. In particular, as the drill head assembly 110 moves in direction A air bladders 235B are compressed to counter the oscillating forces while air bladders 235A are expanded to dissipate the oscillating forces. The air bladder assemblies 215A', 215B' can be similarly configured to counter and dissipate oscillating forces. While two sets of opposing configurations are described, it will be appreciated that any number of air bladder assemblies can be provided.

In addition to countering and/or dissipating oscillating forces, the drilling system 100 shown can also include upper bumpers 270A coupled to an upper portion of the case 210 and lower bumpers 270B coupled to a lower portion of the case 210. The upper bumpers 270A can be coupled to the casing 210 to absorb axial forces in the event that axial forces overcome the air spring forces in the air bladders 235A, 235A'. For example, an axial force of sufficient magnitude to overcome air spring forces in the air bladders 235A, 235A' moves the lower bumpers 270B into contact with the lower bracket supports 260, 260'. Similarly, upper bumpers 270A can be moved into contact with the upper bracket supports 255, 255' as a backup to an axial force overcoming the air spring force associated with air bladders 235B, 235B'. Accordingly, the bumpers 270A, 270B can provide a backstop to absorb axial forces if the air spring forces are overcome.

The various components in the drilling system, drill head assembly, and/or the isolation system can have various configurations. For example, the air bladders included in an isolation system can have any configuration, including any combination of sizes, volumes, locations, and uncompressed/unexpanded pressures. In at least one example, air bladders can have any volume. Further, air bladders can be inflated to any pressure that can be measured when the air bladders are neither compressed nor expanded by forces external to the air bladders. Such pressure can include pressures of between about 0 psi to about 120 psi or more. The air bladders can also be formed of any suitable materials, including rubber, plastic, composite, or any other materials and/or combinations thereof.

In the illustrated example, air bladders are positioned on the outer side of the support brackets between an inner bracket and an outer bracket on axially opposing sides of the drill head assembly. In other examples, air bladders can be positioned inwardly of support brackets and/or on the same axial side of a drill head assembly. As a result, in some examples air bladders can be positioned on either or both sides of a support bracket on either or both axial sides of a drill head assembly. Further, any number of air bladder assemblies can be thus provided.

Additionally, while a drill head assembly has been described that can provide up to 60,000 lbs or more of force at a frequency of up to 150 Hz or greater (a sonic head), it will be appreciated that drill head assemblies can be provided that generate any amount of force at any frequency.

Further, while the guide rails 220, 220' are described as passing through the drill head assembly 110, it will be appreciated that the guide rails 220, 220' can be coupled to the drill head assembly 110 in other ways. For example, guide rails can pass into but not completely through the drill head assembly, guide rails can be exterior to the drill head assembly and coupled thereto, and/or partial guide rails can be coupled to any part of the drill head assembly as desired. In at least one example, the air bladders 235 can be substantially similar. In other examples, the air bladders can be configured differently as desired.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An isolation system, comprising:

a mount assembly adapted to be secured to a support structure;

at least one rail moveably coupled to said mount assembly, said at least one rail being adapted to be fixedly coupled to a vibratory drill head; and at least one air bladder assembly including at least one air bladder, said at least one air bladder assembly being coupled to said at least one rail and said mount assembly;

wherein said at least one air bladder is configured to compress and expand to counter oscillating forces generated by the vibratory drill head as said at least one rail translates relative to said mount assembly.

2. The system of claim 1, further comprising a first bracket and a second bracket, said first bracket being positioned on an opposing side of said at least one air bladder as said second bracket.

3. The system of claim 2, wherein said first bracket is positioned outwardly of said second bracket relative to the drill head and wherein said second bracket is held stationary relative to said first bracket.

4. The system of claim 3, further comprising a second air bladder assembly positioned on an axially opposing side of said at least one air bladder assembly, said second air bladder assembly including at least a second air bladder.

5. The system of claim 4, wherein said second air bladder assembly includes a first bracket and a second bracket, said first bracket being positioned on an opposing side of said at least a second air bladder as said second bracket.

6. The system of claim 5, wherein said first bracket of said second air bladder assembly is positioned outwardly of said second bracket of said second air bladder assembly relative to the drill head.

7. The system of claim 1, further comprising a plurality of air bladder assemblies positioned on an axial side of the drill head and a plurality of air bladder assemblies positioned on an opposing axial side of the drill head.

8. The system of claim 1, wherein said at least one air bladder has a pressure of between about 0 psi and about 120 psi.

9. A drilling system, comprising:

a mount assembly;

at least one rail coupled to said mount assembly;

a drill head configured to generate oscillating forces, said drill head being fixedly coupled to said at least one rail; and an isolation system including at least one air bladder assembly having at least one air bladder;

wherein said at least one rail is configured to transmit oscillating forces generated by said drill head to said at least one air bladder such that said at least one air bladder counters said oscillating forces.

10. The system of claim 9, wherein said at least one air bladder assembly includes:

at least one first bracket coupled to said at least one rail, and at least one second bracket configured to be held stationary relative to said at least one first bracket, wherein said at least one air bladder is positioned at least partially between said at least one first bracket and said at least one second bracket.

11. The system of claim 10, wherein said at least one first bracket includes an outer bracket and said at least one second bracket includes an inner bracket.

12. The system of claim 11, wherein said at least one air bladder assembly comprises a first air bladder assembly located on a first axial side of said drill head and further comprising at least a second air bladder assembly positioned on a second axial side of said drill head, said second axial side being opposite said first axial side.

13. The system of claim 12, further comprising a plurality of air bladder assemblies positioned on said first axial side of said drill head.

14. The system of claim 13, further comprising a plurality of air bladder assemblies positioned on said second axial side of said drill head.

15. The system of claim 12, wherein said drill head includes a casing and wherein said at least one rail passes through said casing and is coupled to said at least one first bracket of said first air bladder assembly.

16. The system of claim 12, wherein said at least one first bracket is positioned outwardly of said at least one second bracket relative to said drill head.

17. The system of claim 16, further comprising at least one bumper positioned between said drill head and said at least one second bracket.

18. The system of claim 12, wherein said drill head is a sonic drill head.

19. The drilling system of claim 9, wherein the drill head is configured to generate sinusoidal oscillating forces.

20. A drilling system, comprising:

a drill head configured to generate oscillating forces;

a mount assembly; and an isolation system including at least one upper air bladder and at least one lower air bladder, wherein said at least one upper air bladder is coupled to said mount assembly on a first side of said drill head, and wherein said at least one lower air bladder is coupled to said mount assembly on a second, opposing side of said drill head;

wherein said at least one upper air bladder is adapted to compress upon movement of said drill head away from said at least one upper air bladder to counter the oscillating forces.

21. The drilling system of claim 20, wherein said mount assembly includes at least one upper support bracket and said isolation assembly includes at least one bracket and at least one guide member coupling said at least one bracket to said drill head, wherein said at least on upper air bladder is positioned to compress and expand due to relative motion between said at least one bracket and said at least one upper support bracket.

22. The drilling system of claim 21, wherein said mount assembly further includes at least one lower support bracket and said isolation assembly includes a second bracket, wherein said at least one lower air bladder is configured to compress and expand due to relative motion between said second bracket and said lower support bracket.

23. The drilling system of claim 20, wherein the drill head is configured to generate sinusoidal oscillating forces.

24. An isolation system, comprising:

a mount assembly adapted to be secured to a support structure;

at least one rail guide adapted to be moveably coupled to said mount assembly, said at least one rail guide-being adapted to be coupled to a vibratory drill head;

at least one air bladder assembly including at least one air bladder, said at least one air bladder assembly being adapted to be coupled to said at least one rail guide and said mount assembly; and a first bracket and a second bracket, said first bracket being positioned on an opposing side of said at least one air bladder as said second bracket;

wherein:

said at least one air bladder is configured to compress and expand to counter oscillating forces generated by the vibratory drill head as said at least one rail guide translates relative to said mount assembly, and said first bracket is positioned outwardly of said second bracket relative to the drill head and wherein said second bracket is held stationary relative to said first bracket.

25. A drilling system, comprising:

a mount assembly;

at least one guide rail coupled to said mount assembly;

a drill head configured to generate oscillating forces, said drill head being fixedly coupled to said at least one guide rail;

an isolation system including at least one air bladder assembly having at least one air bladder;

at least one first bracket coupled to said at least one guide rail; and at least one second bracket configured to be held stationary relative to said at least one first bracket;

wherein:

said at least one guide rail is configured to transmit oscillating forces generated by said drill head to said at least one air bladder such that said at least one air bladder counters said oscillating forces, said at least one air bladder is positioned at least partially between said at least one first bracket and said at least one second bracket, and said drill head includes a casing and wherein said at least one guide rail passes through said casing and is coupled to said at least one first bracket of said first air bladder assembly.

* * * * *